US009388566B2

(12) United States Patent
Showan

(10) Patent No.: US 9,388,566 B2
(45) Date of Patent: Jul. 12, 2016

(54) METHOD OF ERECTING A BUILDING WITH WOODEN PANELS

(76) Inventor: Nicholas Timothy Showan, Canterbury (GB)

( * ) Notice: Subject to any disclaimer, the term of this patent is extended or adjusted under 35 U.S.C. 154(b) by 0 days.

(21) Appl. No.: 14/129,113

(22) PCT Filed: Jun. 28, 2012

(86) PCT No.: PCT/GB2012/051515

§ 371 (c)(1),
(2), (4) Date: Dec. 24, 2013

(87) PCT Pub. No.: WO2013/001305

PCT Pub. Date: Jan. 3, 2013

(65) Prior Publication Data

US 2014/0116000 A1 May 1, 2014

(30) Foreign Application Priority Data

Jun. 28, 2011 (GB) ..... 1110953.5

(51) Int. Cl.
*E04B 1/66* (2006.01)
*E04B 1/35* (2006.01)
(Continued)

(52) U.S. Cl.
CPC ... *E04B 1/66* (2013.01); *B26D 7/01* (2013.01); *B27C 9/04* (2013.01); *B27M 1/08* (2013.01);
(Continued)

(58) Field of Classification Search
CPC ..... B27M 1/08; B27C 5/06; B27C 9/04; B23D 59/008; B23D 47/042; E04B 1/14; E04B 1/7604; E04B 1/26; E04B 1/66; E04B 1/35; E04B 2/86; Y10T 83/654; Y10T 83/04; B26D 7/01
USPC ..... 227/2, 3, 50, 100, 101, 67, 73, 74, 76; 52/741.4, 784.15, 784.16, 745.2, 52/745.19, 794.1, 309.14, 309.4; 144/356, 144/357, 359, 360, 4.1, 242.1, 134.1, 3.1; 83/13, 76.1, 157, 256, 404.2, 401, 83/437.1, 734, 76.9
See application file for complete search history.

(56) References Cited

U.S. PATENT DOCUMENTS 1,959,241 A * 5/1934 Kelley ..... 409/163
3,169,759 A * 2/1965 Mehaffy ..... 269/25
(Continued)

FOREIGN PATENT DOCUMENTS

AU 670466 B2 7/1996
DE 19834616 A1 2/2000
(Continued)

OTHER PUBLICATIONS

Search Report of counterpart British Patent Application No. 1110953.5 issued on Oct. 27, 2011.

*Primary Examiner* — James Ference

(57) ABSTRACT

Method of building construction comprising the steps of: preparing a foundation for a building at a building site; providing an onsite mobile packaged production machine at the building site; providing part data relating to a building design to the onsite mobile packaged production machine; supplying wood to the onsite mobile packaged production machine; the onsite mobile packaged production machine providing building parts formed from the wood and based on the part data in the order of assembly; assembling the building parts on the foundation to form the building, wherein at least external walls including the said building parts include interior and exterior panels having a cavity therebetween; and providing foam insulation into the cavity between the interior and exterior panels. A building formed using the method of construction is also provided. Cutting apparatus and a liquid-laden foam filler for wall panels are also provided.

9 Claims, 5 Drawing Sheets

(51) Int. Cl.

| | |
|---|---|
| ***E04B 1/76*** | (2006.01) |
| ***B27C 9/04*** | (2006.01) |
| ***B27M 1/08*** | (2006.01) |
| ***B26D 7/01*** | (2006.01) |
| ***E04B 1/14*** | (2006.01) |
| *E04B 2/86* | (2006.01) |
| *E04H 9/00* | (2006.01) |

(52) U.S. Cl.

CPC ... *E04B 1/14* (2013.01); *E04B 1/35* (2013.01); *E04B 1/7604* (2013.01); *E04B 2/86* (2013.01); *E04H 9/00* (2013.01); *Y10T 83/04* (2015.04); *Y10T 83/654* (2015.04)

(56) References Cited

U.S. PATENT DOCUMENTS

| | | | | |
|---|---|---|---|---|
| 3,711,007 | A * | 1/1973 | Fry | 227/101 |
| 3,765,587 | A * | 10/1973 | Davis | 227/100 |
| 3,785,913 | A * | 1/1974 | Hallamore | 428/71 |
| 3,951,187 | A | 4/1976 | Chisum | |
| 4,039,112 | A * | 8/1977 | Schultz | 227/40 |
| 4,048,887 | A * | 9/1977 | Morse et al. | 83/79 |
| 4,068,434 | A * | 1/1978 | Day et al. | 52/220.1 |
| 4,068,695 | A * | 1/1978 | Seaman | 144/335 |
| 4,078,348 | A * | 3/1978 | Rothman | 52/309.7 |
| 4,106,538 | A * | 8/1978 | Sigfridsson et al. | 144/376 |
| 4,133,097 | A * | 1/1979 | Slade | 29/564.8 |
| 4,305,538 | A * | 12/1981 | Schultz et al. | 227/2 |
| 4,330,921 | A * | 5/1982 | White, Jr. | 29/432 |
| 4,392,204 | A * | 7/1983 | Prim et al. | 700/227 |
| 4,426,759 | A * | 1/1984 | Burger | 29/407.1 |
| 4,655,268 | A * | 4/1987 | Lundblom | 144/3.1 |
| 4,842,669 | A * | 6/1989 | Considine | 156/288 |
| 4,881,584 | A * | 11/1989 | Wislocker et al. | 144/39 |
| 4,984,351 | A * | 1/1991 | Matsuyama et al. | 483/4 |
| 5,063,665 | A * | 11/1991 | Van Den Eynde | 29/897.312 |
| 5,092,099 | A * | 3/1992 | Valente | 52/745.06 |
| 5,103,880 | A * | 4/1992 | Rice et al. | 144/3.1 |
| 5,176,056 | A * | 1/1993 | Tagliaferri | 83/76.1 |
| 5,429,461 | A * | 7/1995 | Mukherjee et al. | 409/163 |
| 5,435,476 | A * | 7/1995 | Simpson | 227/2 |
| 5,469,674 | A | 11/1995 | Morello | |
| 5,477,899 | A * | 12/1995 | Schmitt | 144/116 |
| 5,547,003 | A | 8/1996 | Susnjara et al. | |
| 5,561,960 | A * | 10/1996 | Minnick et al. | 52/578 |
| 5,685,410 | A * | 11/1997 | Ritola et al. | 198/457.06 |
| 5,701,708 | A * | 12/1997 | Taraba et al. | 52/309.9 |
| 5,771,645 | A * | 6/1998 | Porter | 52/220.2 |
| 5,819,498 | A * | 10/1998 | Geraci | 52/745.1 |
| 5,850,774 | A * | 12/1998 | Naldi | 83/418 |
| 5,953,864 | A * | 9/1999 | Beck | 52/127.11 |
| 5,980,172 | A * | 11/1999 | Shoda | 409/203 |
| 6,142,050 | A * | 11/2000 | Miki | 83/425.2 |
| 6,193,048 | B1 * | 2/2001 | Keith | 198/346.1 |
| 6,196,283 | B1 * | 3/2001 | Hundegger | 144/3.1 |
| 6,205,729 | B1 * | 3/2001 | Porter | 52/309.7 |
| 6,209,284 | B1 * | 4/2001 | Porter | 52/794.1 |
| 6,305,446 | B1 * | 10/2001 | Showan | 144/135.2 |
| 6,418,601 | B1 * | 7/2002 | Olden et al. | 29/281.3 |
| 6,539,830 | B1 * | 4/2003 | Koskovich | 83/13 |
| 6,640,855 | B2 * | 11/2003 | Giles | 144/357 |
| 6,666,367 | B1 * | 12/2003 | Ohnesorge et al. | 227/100 |
| 6,767,619 | B2 * | 7/2004 | Owens | 428/304.4 |
| 6,817,392 | B2 * | 11/2004 | Phillips | 144/39 |
| 6,832,879 | B2 * | 12/2004 | Wassmer | 409/197 |
| 6,986,204 | B2 * | 1/2006 | Glenn | 29/897.3 |
| 7,011,006 | B2 * | 3/2006 | Koskovich | 83/76.8 |
| 7,093,628 | B2 * | 8/2006 | Kelly et al. | 144/360 |
| 7,127,856 | B2 * | 10/2006 | Hagen et al. | 52/309.9 |
| 7,171,738 | B2 * | 2/2007 | Dick et al. | 29/563 |
| 7,181,887 | B1 * | 2/2007 | Baij | 52/105 |
| 7,549,263 | B1 * | 6/2009 | Porter | 52/794.1 |
| 7,559,147 | B2 * | 7/2009 | Fleeman | 29/897.31 |
| 7,591,619 | B1 * | 9/2009 | Chang et al. | 409/212 |
| 7,661,451 | B2 * | 2/2010 | Hundegger | 144/360 |
| 7,792,602 | B2 * | 9/2010 | Dick | 700/180 |
| 7,832,087 | B2 * | 11/2010 | Gilgan et al. | 29/783 |
| 2005/0055973 | A1 * | 3/2005 | Hagen et al. | 52/741.1 |
| 2005/0188649 | A1 * | 9/2005 | Hagen | 52/782.1 |
| 2005/0189040 | A1 * | 9/2005 | Rhodes et al. | 144/356 |
| 2005/0262977 | A1 * | 12/2005 | Wilkerson et al. | 83/13 |
| 2006/0260267 | A1 * | 11/2006 | Hagen et al. | 52/745.19 |
| 2007/0256391 | A1 * | 11/2007 | Mifsud et al. | 52/745.05 |
| 2007/0256392 | A1 * | 11/2007 | Mifsud et al. | 52/745.05 |
| 2007/0261318 | A1 * | 11/2007 | Mifsud et al. | 52/79.1 |
| 2007/0262040 | A1 * | 11/2007 | Mifsud et al. | 212/324 |
| 2007/0271870 | A1 * | 11/2007 | Mifsud et al. | 52/745.2 |
| 2008/0010910 | A1 * | 1/2008 | Baij | 52/105 |
| 2008/0127584 | A1 * | 6/2008 | Schiffmann et al. | 52/293.3 |
| 2008/0184650 | A1 * | 8/2008 | Fischer | 52/606 |
| 2008/0184856 | A1 * | 8/2008 | Koskovich | 83/56 |
| 2009/0107065 | A1 * | 4/2009 | LeBlang | 52/252 |
| 2009/0126299 | A1 * | 5/2009 | Rozhkov | 52/309.4 |
| 2009/0205277 | A1 * | 8/2009 | Gibson | 52/309.9 |
| 2009/0313931 | A1 * | 12/2009 | Porter | 52/309.4 |
| 2010/0024318 | A1 * | 2/2010 | Zhang et al. | 52/79.5 |
| 2010/0043923 | A1 * | 2/2010 | Arvin | 144/363 |
| 2010/0154934 | A1 * | 6/2010 | Hatch et al. | 144/363 |
| 2010/0235206 | A1 * | 9/2010 | Miller et al. | 705/7 |
| 2010/0263511 | A1 * | 10/2010 | Firth | 83/473 |
| 2010/0325989 | A1 * | 12/2010 | Leahy | 52/270 |

FOREIGN PATENT DOCUMENTS

| | | | |
|---|---|---|---|
| EP | 2025480 | A1 | 2/2009 |
| EP | 2348161 | A2 | 7/2011 |
| GB | 2436989 | A | 10/2007 |
| JP | 2009006518 | A | 1/2009 |
| WO | 9733732 | A1 | 9/1997 |
| WO | 2004055298 | A2 | 7/2004 |
| WO | 2007009222 | A1 | 1/2007 |
| WO | 2009139638 | A2 | 11/2009 |

* cited by examiner

METHOD OF ERECTING A BUILDING WITH WOODEN PANELS

The present invention relates to a method of building construction, cutting apparatus which may be used with the said method, and water-laden foam material which may also be used in the said method.

It is known to utilise wooden panels, such as plywood, in building construction, and these wooden panels may be used to form structural parts of exterior and interior walls of the building. Typically, an outer plywood layer and an inner plywood layer connected together leaving a gap therebetween, and insulation is inserted into the gap.

However, a significant logistical problem arises in that the wall panels are prefabricated and pre-insulated offsite at a manufacturing location, before then being transported to the building site for construction. These panels can often be very large. This causes transportation and hoisting issues, and often results in damage during loading, transit, unloading and/or lifting during construction, as well as requiring extremely accurate pre-forming from part data derived from the building design. If any mistakes during offsite manufacture occur, construction must be halted until a replacement part can be ordered.

Furthermore, with known offsite manufacturing techniques, the door and window openings are included at the time of manufacture. However, this requires a careful design strategy to avoid large panels with weak points liable to damage during transport to the building site and hoisting and maneuvering during construction.

If considering onsite production of parts, a skilled workforce is then required to manually produce the parts. Production must be swift enough that the construction team is not left waiting for parts.

Furthermore, cutting machines for automated cutting of materials are well known, but suffer from the fact that not all faces and edges can be processed automatically. On known machines, one or more fixed clamps are required to hold a workpiece in place. However, this then occludes a portion of a surface to be worked. As such, an operator must reclamp the workpiece during processing to allow access to the initially occluded or obstructed portions before the job can be completed.

Additionally, traditional stonework buildings have good heat capacity characteristics, since a large thermal mass aids in retaining stored heat energy. However, switching to increasingly common wooden structure buildings lowers this available thermal mass considerably, leading to the potential for greater cold weather and night time heating requirements.

The present invention seeks to provide a solution to these problems.

According to a first aspect of the invention, there is provided a method of building construction, the method comprising the steps of: a) preparing a foundation for a building at a building site; b) providing an onsite mobile packaged production machine at the building site; c) providing part data relating to a building design to the onsite mobile packaged production machine; d) supplying wood to the onsite mobile packaged production machine; e) the onsite mobile packaged production machine providing building parts formed from the wood and based on the part data in the order of assembly; f) assembling the building parts on the foundation to form the building, wherein at least external walls including the said building parts include interior and exterior panels having a cavity therebetween; and g) pumping foam insulation into the cavity between the interior and exterior panels.

Preferable and/or optional features of the first aspect of the invention are set forth in claims 2 to 11, inclusive.

According to a second aspect of the invention, there is provided a building formed using a method in accordance with the first aspect of the invention.

According to a third aspect of the invention, there is provided cutting apparatus comprising a longitudinal processing path, a plurality of clamping elements controllable to move independently along at least one longitudinal side of the processing path, each clamping element being operable to clamp and move a workpiece on the longitudinal processing path whilst at least one other said clamping element is unclamped from the workpiece, whereby a workpiece is feedable along the longitudinal processing path from clamping element to clamping element, and two processing heads which are controllable to move laterally of and towards and away from the longitudinal processing path, the two processing heads being oriented to face in opposing directions, so that opposite faces of a workpiece can be worked simultaneously and, due to the independently controllable clamping elements, opposite edges of the workpiece in the longitudinal direction of the processing path can be processed simultaneously as the workpiece is moved along the processing path by the clamping elements.

Preferable and/or optional features of the third aspect of the invention are set forth in claims 14 to 27, inclusive.

According to a fourth aspect of the invention, there is provided a method of cutting a workpiece using cutting apparatus according to the third aspect of the invention, the method comprising the step of: moving a workpiece along a longitudinal processing path by a plurality of independently movable clamping elements feeding the workpiece from one clamping element to another, so that the workpiece passes between opposed processing heads which are controllable to move laterally of and towards and away from the longitudinal processing path, wherein opposite faces of the workpiece can be worked simultaneously and, due to the independently movable clamping elements, opposite edges of the workpiece in the longitudinal direction of the processing path can be processed simultaneously as the workpiece is moved along the processing path by the clamping elements.

According to a fifth aspect of the invention, there is provided a liquid-laden foam insulator comprising a closed-cell foam material having a multiplicity of cells, each cell including a liquid held therein.

Preferably, the liquid is water.

More preferably, the insulator is flowable and settable.

The invention will now be more particularly described, by way of example only, with reference to the accompanying drawings in which.

Referring firstly to FIGS. 1A, 1B, 2 to 4 of the drawings, there is shown a building site 10 having a foundation 12, partially constructed building 14, and onsite mobile packaged production machine 16. The building design, including layout and required foundation, is finalised offsite and prior to work commencing. The designer or architect has complete control over the design, including shape, size and form. Windows, openings and doorways of any size are also accommodated within the initial design. Since the entire construction process will be onsite, rather than partial construction offsite as is traditional, transportation and handling problems of larger or complex parts are overcome.

A full and complete three-dimensional design, including exact positioning of pipework, cabling, ducting and such like, is finalised by the designer offsite prior to work commencing. Costings are thus approved due to the accurate and detailed design.

Computer-generated parametric design models are utilised to incorporate any options and changes in detail.

The building model is thus created and finalised offsite using a CAD package, and may be verified using a computer-aided engineering, or CAE, package.

Figure 1A:
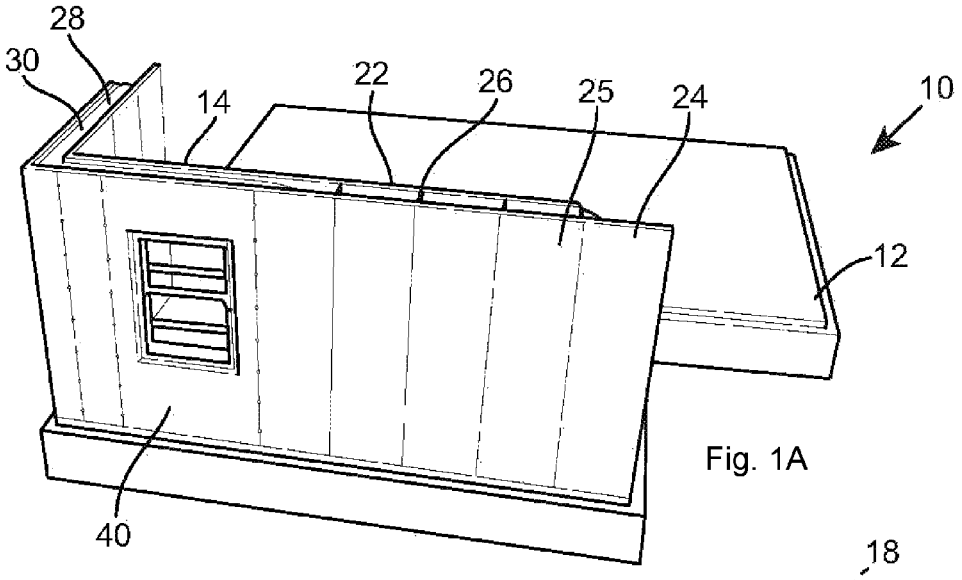
FIG. 1A and FIG. 1B show perspective views of a building site showing a partially constructed building using a method in accordance with the first aspect of the invention.
Figure 1B:
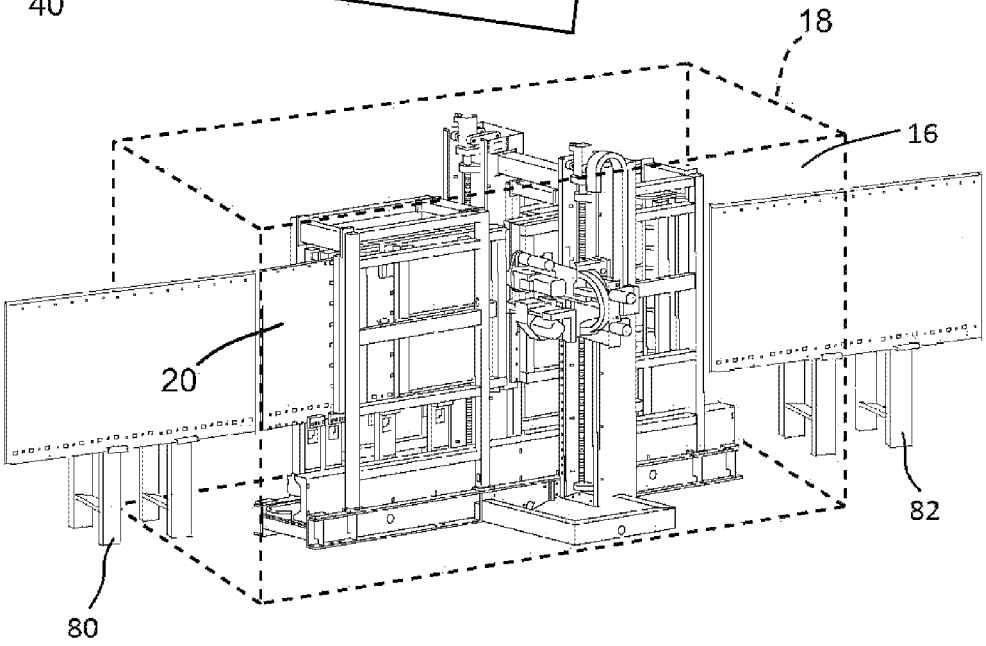

With the building site 10 prepared, the onsite mobile packaged production machine 16 is temporarily installed. Preferably, this is permanently housed in a container 18, such as a 30 foot (9 meter) ISO container, and as such can be delivered to the site, as shown in FIG. 1A and FIG. 1B. Exact part data for the entire building is outputted by the CAD package, and a suitable amount of material is also ordered for delivery to the building site 10.

The foundation 12 of the building 14 is laid in accordance with the CAD part data. The onsite mobile packaged production machine 16 utilises computer-aided manufacturing, known as CAM. The building design model generated by the offsite CAD package and preferably verified in a computer-generated engineering, or CAE, package is inputted to the CAM system of the onsite mobile packaged production machine 16 to automate the cutting process of the building components based on the building part data.

Beneficially, to reduce labour costs, skill requirements and construction time, the onsite mobile packaged production machine 16 outputs building parts in the order of assembly, and preferably a just-in-time, or JIT, processing method is utilised so that completed building parts are not being stacked and stored for significant durations prior to assembly.

To this end, the onsite mobile packaged production machine 16 may be utilised in conjunction with a magazine for batch feeding unprocessed material to the onsite mobile packaged production machine 16 for cutting. Furthermore, the onsite mobile packaged production machine 16 may restock the magazine with processed parts in the order of assembly so that the magazine can be moved closer to the construction area whilst a further magazine feeds a new batch of material to the onsite mobile packaged production machine 16.

The onsite mobile packaged production machine 16 preferably processes wooden panels 20, and more preferably suitably treated plywood panels. The wooden panels 20 are assembled onsite to form an interior layer 22 and a spaced exterior layer 24. The interior and exterior layers 22, 24 are held in spaced relationship by perpendicularly extending spacers 26, thereby creating a wall 25 with an insulating cavity 28. The spacers 26 may include flow apertures to allow for passage of liquid insulating foam 30 which is inserted following completion of the walls 25.

Figure 2:
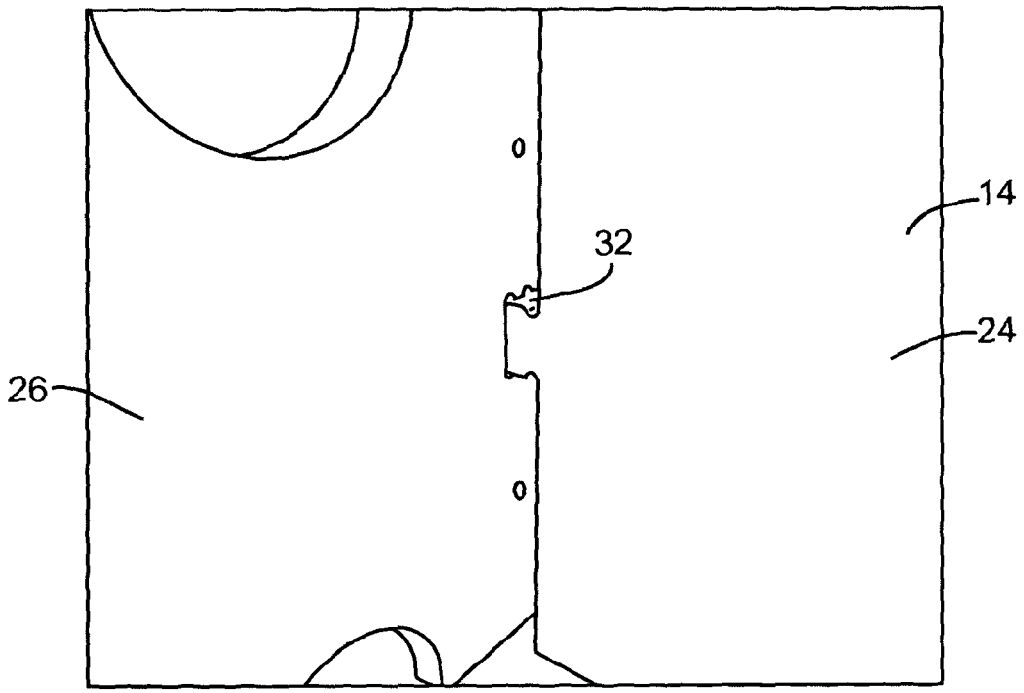
FIG. 2 shows an enlarged view of a joint between a connector and a wall panel of the building shown in FIG. 1A and FIG. 1B.
Figure 3:
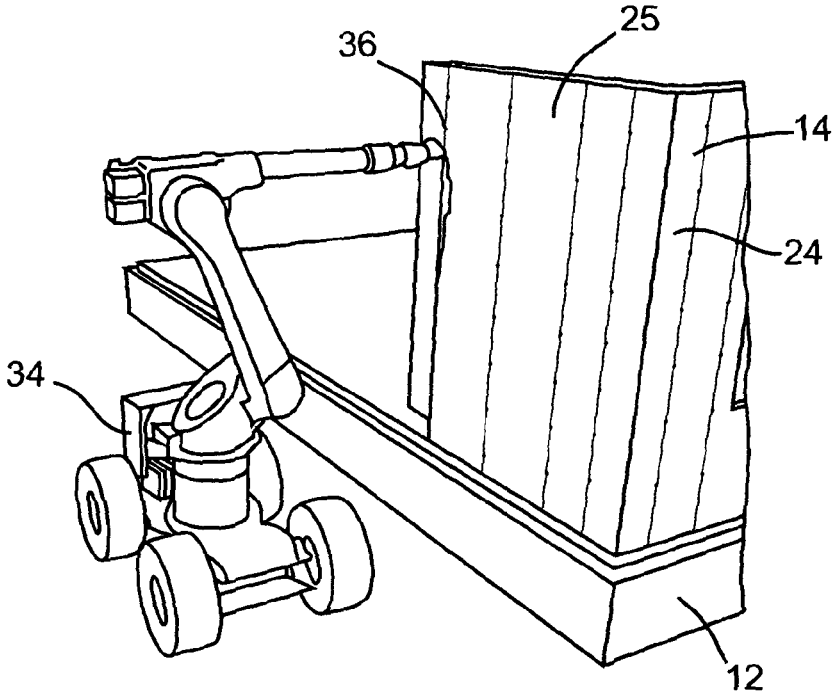
FIG. 3 shows robotic fastening apparatus for applying fastenings automatically to the wall panels.

The onsite mobile packaged production machine 16, using the building part data, forms the panels 20 with mortise and tenon joints 32, as shown in FIG. 2, or any other suitable joints or combination of joints. With the exterior and interior wall 25 layers 22, 24 jointed together, a fastener 34 can finish by screwing or nailing neighbouring panels 20 together. The fastener 34 may conveniently be a wheeled robotic fastening machine having sensing apparatus for determining panel gaps 36. Once a panel gap 36 is identified as the robotic fastening machine moves around the structure, a row of spaced apart fasteners can be inserted along both sides of the panel gap 36 to engage the outer panels 20 with an interior overlapping element 38. Alternatively, the fastening of adjacent panels may be undertaken manually.

A double-skinned webbed, preferably plywood, construction 40 can thus be formed. As the interior and exterior panels 22, 24 of the wall 25 are being erected, the building part data dictates and directs the inclusion of pipework, cabling and ducting 39 within the cavity 28 as required by the parametric model of the building design.

If a part is damaged during assembly, the onsite mobile packaged production machine 16 can be utilised to provide a new part with minimal downtime.

Higher levels of the structure are reached preferably by the use of platform lifts internally and/or externally, if required.

Figure 4:
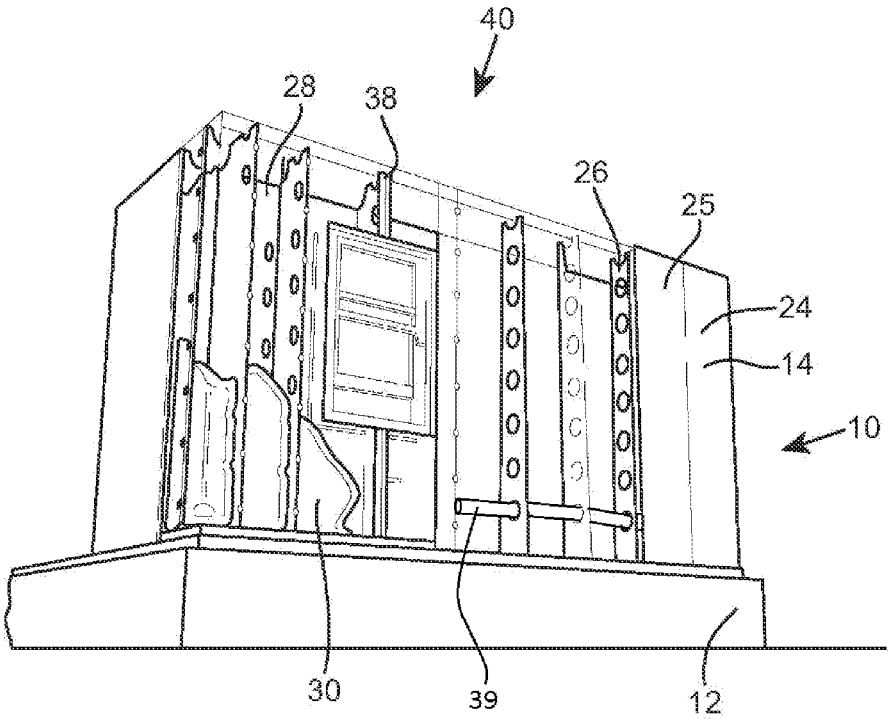
FIG. 4 shows an insulation filling process of the cavities between interior and exterior wall panels, in accordance with the first aspect of the invention and preferably utilising water-laden foam in accordance with the fourth aspect of the invention.

With the walls 25 erected and fastened in place, the insulation cavities 28 between the interior and exterior panels 22, 24 are filled with insulating liquid foam 30, as shown in FIGS. 1A, 1B and 4. Once cured, the walls 25 become extremely strong and robust.

A roof of the building 14 can be created in a similar manner.

A microelectromechanical system, also known as MEMS or 'smart dust', may be incorporated in distributed manner throughout cavities 28 of the walls 25 and also optionally the roof of the building 14. MEMS is the technology of very small mechanical devices driven by electricity and being formed of components between 1 to 100 micrometers in size. Each unit comprising the system includes a central data processing unit, a microprocessor and at least one sensor for monitoring a local ambient condition. In this case, a MEMS is included with the insulation in order to monitor, for example, building integrity. MEMS incorporated within a building is advantageous in determining the effects of earthquakes, for example, on the building structure. To charge the MEMS devices, inductive charging may be utilised through the wall panels 20. Additionally or alternatively, an energy harvesting device utilising for example an onboard micro-piezoelectric generator may be incorporated on or within each device. An output from each device would typically be collated via a computer interface, allowing a user to check the outputted data.

Since the onsite mobile packaged production machine 16 is manufacturing panels in real time during construction, window and door openings are automatically incorporated during the onsite production process. The required window frames and door frames are delivered to the site, and inserted, fastened and sealed in place as construction progresses.

Interior walls 25 may also be formed in the same manner as the exterior walls 25. To improve the thermal mass of the construction, due to the use of less dense wooden materials and aerated foam insulation 30, a water or liquid-laden foam insulator material can be utilised on wall surfaces, and preferably interior wall surfaces. Pockets, voids, cavities, cells or bubbles within traditional foam insulation can be utilised to carry water or other thermally dense liquid instead of air. By trapping the liquid or water within the foam insulation, the thermal mass of the foam is significantly increased.

To produce the liquid-laden foam insulator, the aeration process during the production of traditional insulating foam is modified to include, for example, atomised water or other suitable thermally dense liquid.

The liquid-laden foam insulator may also be utilised within the cavities formed between the previously described wall panels.

Preferably, the liquid-laden foam insulator may be flowable when applied, but solidifies once cured. During the curing process, the entrained liquid may migrate to the plurality of cells, cavities or voids within the material. Alternatively, the liquid-laden foam insulator may be formed offsite as solidified units or panels, and transported to the site for installation.

Once complete, the onsite mobile packaged production machine 16 is removed, for example, by a flat-bed lorry carrying the container 18 away.

Figure 5:
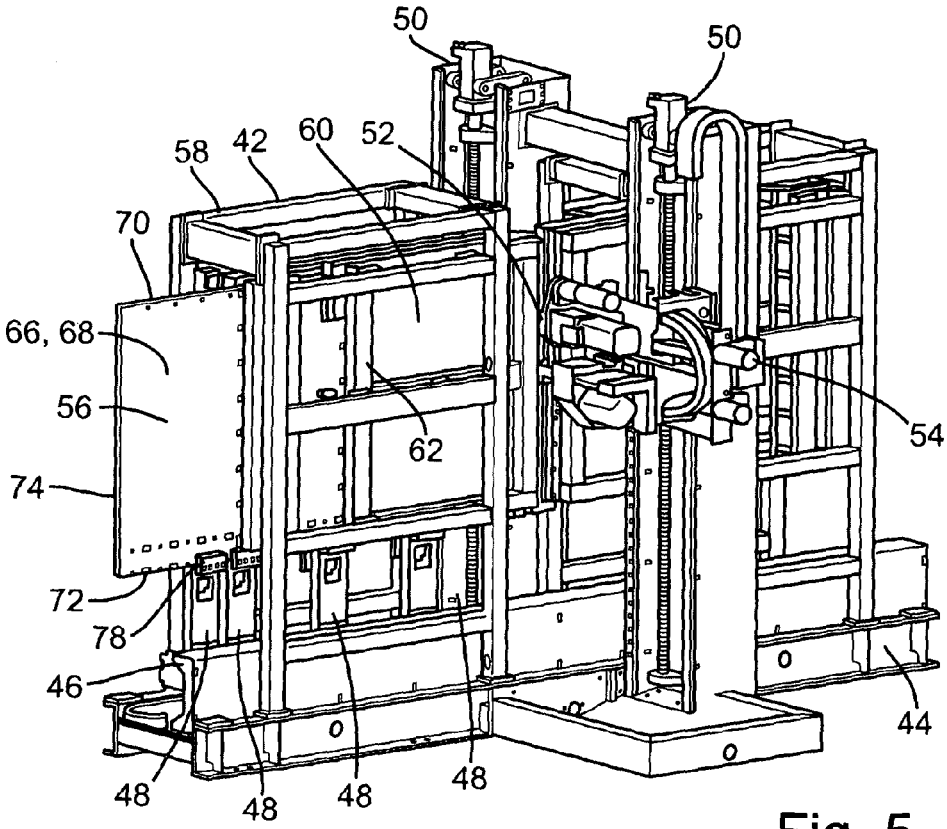
FIG. 5 is a perspective view of a cutting machine, in accordance with the third aspect of the invention.
Figure 6:
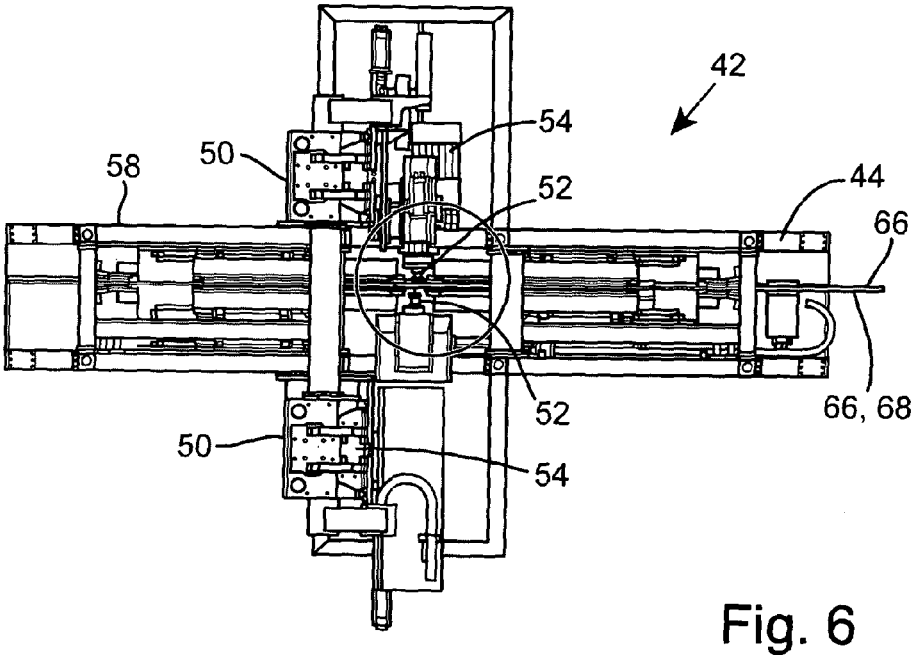
FIG. 6 is a plan view of part of the cutting machine, showing processing heads.
Figure 7:
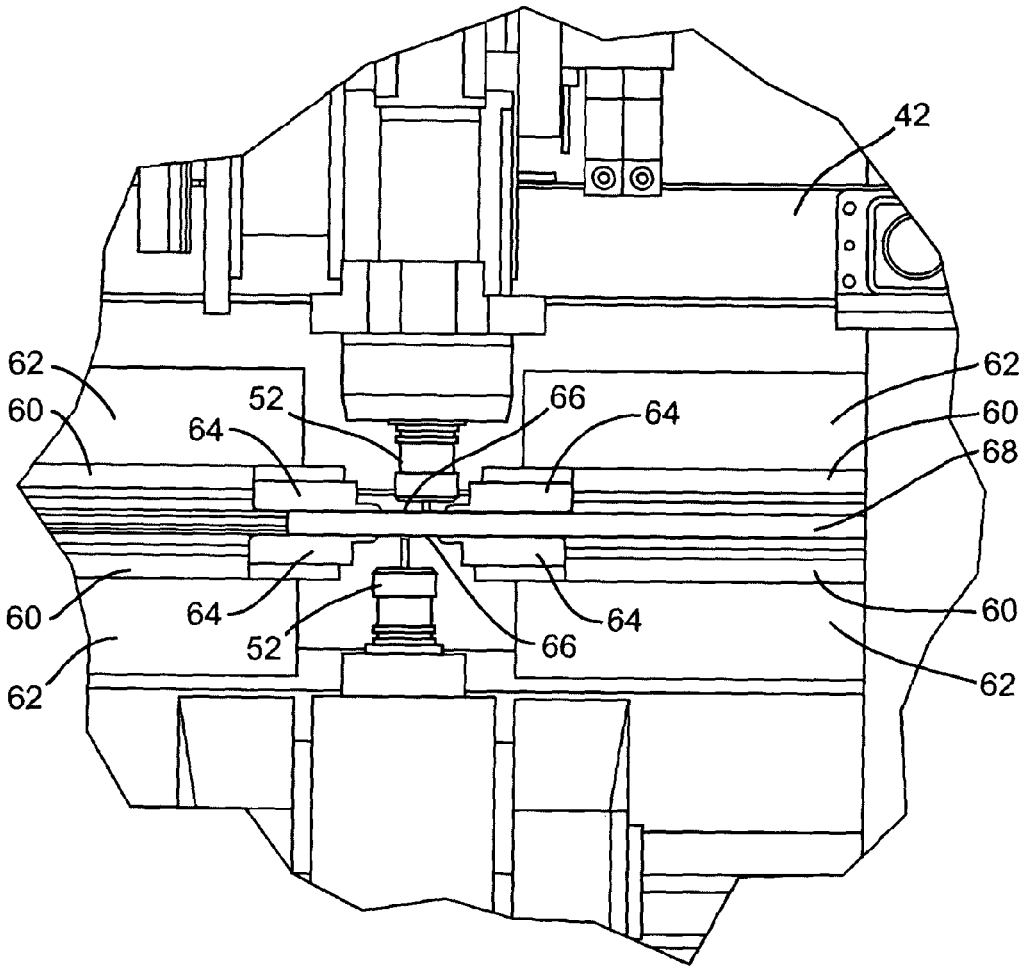
FIG. 7 is an enlarged plan view of part of the cutting machine shown in FIG. 6, and showing scraper bars.

Referring now to FIGS. 5 to 7 of the drawings, there is shown an embodiment of cutting apparatus 42, which may be utilised as part of the onsite mobile packaged production machine 16 described above, or in other different applications.

The cutting apparatus 42 comprises an elongate base support 44 on which is mounted a longitudinal horizontal track 46. A plurality of clamping elements 48 are controllable to be independently movable on the horizontal track 46. The clamping elements 48 at least in part define one longitudinal side of a planar processing path 56. Two opposing vertical tracks 50 are provided on wings of the support 44 partway, and generally midway, between its ends. The horizontal track 46 passes between the vertical tracks 50, and a processing head 52 is slidably movable on each vertical track 50.

As with the clamping elements 48, the processing heads 52 are computer-controlled to adjust their respective positions in accordance with part data that is inputted. Each processing head 52 includes a movement mechanism 54 which enables vertical positional adjustment laterally of the processing path 56, as well as towards, away and through the plane of the processing path 56.

The processing heads 52 are oriented in opposite directions, whereby they are substantially coplanar.

An outer frame 58 is mounted on the support 44, and this in turn supports inner guides comprising a platen 60 supported by an inner frame 62. A pair of platens 60 are provided each side of the plane of the processing heads 52, and in parallel or substantially parallel with the plane of the processing path 56. The plane of the processing path 56 therefore, in this embodiment, extends with the horizontal track 46 and vertically.

A spacing between opposing parallel platens 60 may be adjustable by servo motors moving the respective inner frames 62. Alternatively, one platen 60 of a pair may be fixed whilst the other platen 60 is moveable to adjust a spacing therebetween.

A scraper bar 64 may be incorporated at or adjacent to an end of each platen 60 nearest the processing heads 52.

The platens 60 and scraper bars 64 are optional but preferable in aiding to guide panel-type workpieces along the processing path 56. The platens 60 and scraper bars 64 may be dispensed with when processing joists or other thicker kinds of timber or material.

It would be feasible to include a further upper horizontal track above and in parallel with the lower first said horizontal track 46. Further clamping elements may thus be provided on this upper horizontal track. In this case, each upper clamping element may be controllable to move in unison with its counterpart lower clamping element 48. Alternatively, the upper clamping elements, which themselves are independently moveable relative to at least one other upper clamping element, may be independently movable relative to the lower clamping elements 48. The required movement would be dependent on the material being processed and the part data dictating the cutting.

If upper and lower clamping elements were provided, then it is feasible that the platens 60 and scraper bars 64 could be dispensed with. However, for panel-type workpieces, the platens 60 and scraper bars 64 are beneficial for rigidly supporting the workpiece at or close to the plane of the processing heads 52. This enables detailed and accurate cutting work to be imparted to the workpiece by the processing heads 52 without or with limited flex of the workpiece.

The workpiece is moved along the processing path 56 by the independently controllable clamping elements 48. The workpiece is fed from one clamping element 48 to another clamping element 48 through the plane of the processing heads 52. In this way, not only can opposite major surfaces 66 of the workpiece 68 be worked simultaneously and independently by the processing heads 52, but also the upper and lower edges 70, 72 of the workpiece 68 can be worked without interference by the clamping elements 48, since the clamping elements 48 do not pass through the plane of the processing heads 52 if areas of the workpiece 68 occluded, blocked or covered by the clamping elements 48 require cutting or processing.

Furthermore, the leading and trailing edges 74 of the workpiece 68 can also be worked by the processing heads 52 during a single pass of the workpiece 68 through the cutting apparatus 42, as the clamping elements 48 feed the workpiece 68 through the plane of the processing heads 52.

The jaws 78 of the clamping elements 48 are typically adapted to hold flat or planar workpieces 68. However, one or more jaws 78 of each clamping element 48 may be adapted to hold a specific profile of the workpiece 68.

The processing path in this case is vertical with a horizontal movement direction. This is advantageous in that it utilises gravity to enable location of the workpiece with the clamping elements. However, the processing path may be horizontal with a horizontal movement direction. In this latter case, it would therefore be preferable to include two sets of clamping elements at each longitudinal side of the processing path to prevent or limit the possibility of skewing of the workpiece as it is moved therealong.

In this embodiment, four clamping elements are suggested, and typically two clamping elements would be on each side of the plane of the processing heads during the cutting phase in order to support the workpiece on each side of the plane of the processing heads. However, it may be feasible to utilise only two or three clamping elements, and certainly more than four clamping elements would be possible.

The horizontal track extends beyond the outer frame, whereby one or more clamping elements receive a workpiece from a feeder magazine 80 as illustrated in FIG. 1. Conveniently, this would provide automation of the cutting process for a plurality of workpieces held by the feeder magazine 80. A collector magazine 82 is provided at the other end of the horizontal track to receive finished or processed workpieces. Alternatively, the finished or processed workpiece may be returned to the feeder magazine 80 prior to the clamping elements collecting a new or unprocessed workpiece.

Advantageously, by providing the feeder magazine and, if used, the collector magazine on respective conveyors, greater automation of the cutting process can be achieved.

The onsite mobile packaged production machine and/or the cutting apparatus may also include an integrated printer for printing guides on the interior and/or exterior panels during onsite production and dependent on the part data. For example, if decorative brickwork is to be added to the exterior and/or interior wall panels, guidelines can be printed during production. Similarly, guide lines for tiles or any other covering can be include.

If a second set of clamping elements are provided on a second horizontal track spaced vertically above the first horizontal track and in parallel with the first horizontal track, then the clamping elements of the second set may move in unison with their corresponding counterparts on the first horizontal track, or independently.

Furthermore, the clamping elements may be independently height adjustable, so as to extend towards or away from a workpiece. Additionally or alternatively, the first horizontal track may be movable in its lateral direction and/or its longitudinal direction to approach or to be spaced further away from a workpiece. If two parallel spaced coplanar horizontal tracks or tracks on which the clamping elements run are provided, then these tracks may be movable relative to each other.

It is thus possible to provide a method of building construction which forms structural insulated panels, also known as SIPs, onsite, thereby providing a very low carbon footprint in terms of building, running and maintaining the building. The method is also beneficial for construction in inaccessible areas, due to onsite construction of the basic components. By removing the necessity for substantial offsite pre-manufacture of the wall panels, the logistics associated with transport and lifting, including problems associated with maintaining structural integrity due to window and door opening requirements is largely mitigated. The precision core provided by the onsite precision formed wall panels serves as a guide for further work, enabling the deskilling of the entire building process. General waste is also minimised due to the known exact requirements from the pre-determined part data. Furthermore, the use of water or other liquid laden foam material provides a greatly increased thermal mass to the structure, improving heat retention. Furthermore, it is also possible to provide cutting apparatus which, by using a shuffle type feed mechanism whereby a workpiece is feed from one clamping element to another, all faces and edges of the workpiece can be processed in one run without requiring manual intervention to reset occluding or blocking clamps.

The embodiments described above are provided by way of examples only, and various other modifications will be apparent to persons skilled in the field without departing from the scope of the invention as defined by the appended claims.

The invention claimed is:

1. A method of erecting a building, the method comprising the steps of:

a) preparing a foundation for a building having external walls at a building site;

b) providing an onsite mobile packaged production machine at the building site, the onsite mobile packaged production machine having both an auto-feed magazine for wood and a collector magazine;

c) providing part data relating to a building design to the onsite mobile packaged production machine;

d) supplying wood to the auto-feed magazine of the onsite mobile packaged production machine;

e) the onsite mobile packaged production machine, based on the part data, automatically in a predetermined order of assembly providing building parts cut from the wood, and collecting the building parts via the collector magazine;

f) assembling the building parts on the foundation to form an entire building at the building site, wherein the external walls of the building include interior panels, exterior panels, and a cavity between the interior panels and the exterior panels; and g) providing foam insulation into the cavity between the interior and exterior panels.

2. The method as claimed in claim 1, wherein the onsite mobile packaged production machine is housed in and operated from within a transport container when at the building site.

3. The method as claimed in claim 1, further comprising a step h) subsequent to step g) of moving the onsite mobile packaged production machine from the building site on a bed of a transport lorry.

4. The method as claimed in claim 1, wherein, in step f), ducts for accommodating pipework and cabling are introduced during the assembling of the building parts.

5. The method as claimed in claim 1, wherein, in step g), a MEMS array is included in the cavity with the insulation for monitoring building integrity.

6. The method as claimed in claim 1, wherein the onsite mobile packaged production machine includes an integrated printer for printing on the wood in step e).

7. The method as claimed in claim 1, further comprising the step of providing a liquid-laden foam filler on at least one of said interior panels, the liquid-laden foam filler having a multiplicity of cells having a liquid trapped therein.

8. A method of erecting a building, the method comprising the steps of:

a) preparing a foundation for a building having external walls at a building site;

b) providing an onsite mobile packaged production machine at the building site, the onsite mobile packaged production machine having both an auto-feed magazine for wood and a collector magazine;

c) providing part data derived from computer-aided design relating to a building design to the onsite mobile packaged production machine;

d) supplying wood to the auto-feed magazine of the onsite mobile packaged production machine; e) the onsite mobile packaged production machine, based on the part data, in a predetermined order of assembly providing building parts cut from the wood, and collecting the building parts via the collector magazine;

f) assembling the building parts on the foundation to form the building, wherein the external walls of the building include interior panels, exterior panels, and a cavity between the interior panels and the exterior panels; and g) providing foam insulation into the cavity between the interior and exterior panels.

9. A method of erecting a building, the method comprising the steps of:

a) preparing a foundation for a building having external walls at a building site;

b) providing an onsite mobile packaged production machine at the building site, the onsite mobile packaged production machine having both an auto-feed magazine for wood and a collector magazine;

c) providing part data relating to a building design to the onsite mobile packaged production machine;

d) supplying wood to the auto-feed magazine of the onsite mobile packaged production machine;

e) the onsite mobile packaged production machine, based on the part data, sequentially in a predetermined order of assembly providing a plurality of different building parts cut from the wood, and collecting the building parts via the collector magazine;

f) assembling the building parts on the foundation to form the building, wherein at least the external walls of the building include interior panels, exterior panels, and a cavity between the interior panels and the exterior panels; and g) providing foam insulation into the cavity between the interior and exterior panels.

* * * * *